US005595198A

United States Patent [19]

Kemmerer

[11] Patent Number: 5,595,198

[45] Date of Patent: Jan. 21, 1997

[54] MASCARA APPLICATOR AND METHOD OF MAKING THE SAME

[75] Inventor: Walter K. Kemmerer, Cortlandt Manor, N.Y.

[73] Assignee: Risdon Corporation, Naugutuck, Conn.

[21] Appl. No.: 472,955

[22] Filed: Jun. 7, 1995

[51] Int. Cl.[6] ..... A45D 40/26

[52] U.S. Cl. ..... 132/218; 132/313; 132/317; 132/320

[58] Field of Search ..... 132/218, 313, 132/317, 320; 15/206, 164, 167.3, 207

[56] References Cited

U.S. PATENT DOCUMENTS

| | | | |
|---|---|---|---|
| D. 331,150 | 11/1992 | Hartel . | |
| 2,465,396 | 3/1949 | Peterson et al. . | |
| 2,637,893 | 5/1953 | Shaw . | |
| 2,895,155 | 7/1959 | Peterson . | |
| 3,344,457 | 10/1967 | Grobert . | |
| 4,307,478 | 12/1981 | Ward et al. . | |
| 4,365,642 | 12/1982 | Costa . | |
| 4,403,624 | 9/1983 | Montgomery . | |
| 4,461,312 | 7/1984 | Gueret . | |
| 4,545,393 | 10/1985 | Gueret et al. . | |
| 4,561,456 | 12/1985 | Gueret . | |
| 4,565,205 | 1/1986 | Taylor . | |
| 4,598,723 | 7/1986 | Cole | 132/218 |
| 4,660,582 | 4/1987 | Taylor . | |
| 4,705,053 | 11/1987 | Goncalves | 132/218 |
| 4,733,425 | 3/1988 | Hartel et al. | 132/218 |
| 4,804,004 | 2/1989 | Taylor . | |
| 4,861,179 | 8/1989 | Schrepf et al. . | |
| 4,887,622 | 12/1989 | Gueret . | |
| 4,927,281 | 5/1990 | Gueret | 132/218 |
| 4,961,665 | 10/1990 | Fitjer . | |
| 4,974,612 | 12/1990 | Gueret . | |
| 4,993,440 | 2/1991 | Gueret | 132/218 |
| 5,002,415 | 3/1991 | Gueret . | |
| 5,063,947 | 11/1991 | Gueret . | |
| 5,064,306 | 11/1991 | Gueret . | |
| 5,096,319 | 3/1992 | Gueret . | |
| 5,161,554 | 11/1992 | Fitjer . | |
| 5,165,760 | 11/1992 | Gueret . | |
| 5,238,011 | 8/1993 | Gueret . | |
| 5,335,465 | 8/1994 | Gueret | 132/218 |
| 5,345,644 | 9/1994 | Gueret . | |

*Primary Examiner*—Gene Mancene
*Assistant Examiner*—Pedro Philogene
*Attorney, Agent, or Firm*—St. Onge Steward Johnston & Reens

[57] ABSTRACT

An applicator for the application of mascara to the eyelashes is disclosed having a central core formed from a twisted wire and having a brush section at one end of the central core. The brush section comprises a plurality of regularly disposed and radially extending bristles which are disposed in a helical array by the twisted wire. At least some of the bristles have reduced length and are arranged so as to form a substantially helical groove through the brush section. A process in accordance with the present invention includes the steps of providing an applicator having radially extending bristles and removing at least a portion of at least some of the bristles so as to reduce the length of at least some of the bristles. After the desired portions of the bristles have been removed, or cut, the core (or just the brush section) is rotated about one hundred eighty degrees to about four hundred eighty degrees such that the bristles having portions removed therefrom form a helical groove through the brush section.

11 Claims, 3 Drawing Sheets

MASCARA APPLICATOR AND METHOD OF MAKING THE SAME

FIELD OF THE INVENTION

The present invention relates to the application of cosmetics, and more particularly to applicator devices for applying cosmetics, such as mascara, to the eyelashes.

BACKGROUND OF THE INVENTION

Mascara applicators, sometimes referred to as mascara brushes, which apply mascara to a user's eyelashes are known. Some mascara applicators are comprised of a core formed from a single metallic wire reversibly folded in a generally u-shaped configuration. Bristles (sometimes referred to as filaments), usually comprised of strands of nylon, are disposed between the u-shaped wire. The u-shaped wire is then rotated, or twisted, to form a helical core which holds the filaments substantially at their midpoints so as to clamp them in a helical or spiral manner. See, for example, U.S. Pat. No. 2,465,396 to R. O. Peterson et al.; U.S. Pat. No. 2,895,155 to R. O. Peterson; U.S. Pat. No. 4,887,622 to Gueret; and U.S. Pat. No. 4,733,425 to Hartel et al.

As is known, mascara applicators are inserted into a container having a reservoir of mascara or some other cosmetic medium. The bristles are arranged so as to pick up a supply of mascara and carry it from the container for application to a user's eyelashes. See, for example, U.S. Pat. No. 4,365,642 to Costa; U.S. Pat. No. 4,733,425 to Hartel et al.; and U.S. Pat. No. 4,887,622 to Gueret. These mascara applicators attempt to maximize the amount of mascara carried by the applicator and attempt to apply the mascara in a uniform and attractive manner, while simultaneously combing the eyelashes in a desired fashion.

Conventional applicators having bristles of substantially equal length as described above, however, fail to maximize the amount of mascara picked up by the applicator from the mascara reservoir for application to the eyelashes, thus requiring the user to introduce the applicator into the reservoir several times. Conventional applicators also fail to apply the mascara in a uniform manner and fail to desirably comb the lashes with a single stroke. Thus, a user is forced to repeatedly stroke the eyelashes to effect a uniform application and to achieve the desired combed look. In addition, because the mascara carrying surface and mascara retention is not maximized, a user is forced to repeatedly introduce the applicator into the mascara reservoir until a desired amount of mascara has been applied.

What is desired, therefore, is a mascara applicator which picks up and carries a desirable amount of mascara for application to the eyelashes with a reduced number of introductions of the applicator into the mascara reservoir when compared to conventional applicators, which provides a smooth and uniform application of the mascara to the eyelashes, and which applies mascara and simultaneously combs the eyelashes with a reduced number of strokes in comparison to conventional mascara applicators.

SUMMARY OF THE INVENTION

Accordingly, it is an object of the present invention to provide a mascara applicator and method of making the same which picks up and carries a desirable amount of mascara for application to the eyelashes.

It is another object of the present invention to provide a mascara applicator and method of making the same which applies mascara to the eyelashes in a smooth and uniform fashion.

It is still a further object of the present invention to provide a mascara applicator and method of making the same which both applies mascara and simultaneously combs the eyelashes with a reduced number of strokes when compared to conventional mascara applicators.

It is a further object to provide a mascara applicator which requires a reduced number of introductions to the mascara reservoir during use when compared to conventional mascara applicators.

To overcome the deficiencies of the prior art and to achieve the objects and advantages listed above, a mascara applicator is disclosed which comprises a central core preferably formed from a twisted wire and having a brush section at one end thereof. The brush section comprises a plurality of regularly disposed and radially extending bristles which are disposed in a helical array by the twisted wire. At least a portion of some of the bristles are removed, or cut, to a desired length to substantially form a groove or channel through at least a portion of the brush section and then the brush section (or, if desirable, the entire core) is rotated or twisted about one full turn causing the groove to be helically positioned throughout the brush section.

A method in accordance with the present invention comprises the steps of providing a central core formed from preferably a twisted wire holding a helical array of regularly disposed and radially extending bristles at one end thereof. At least a portion of at least some of the bristles are removed, or cutaway, so as to form bristles having a reduced length. Then, the brush section or core is rotated about one hundred eighty degrees to about four hundred eighty degrees, most preferably about three hundred sixty degrees, so as to arrange the bristles having a reduced length in a substantially helical pattern throughout the brush section.

The mascara applicator of the present invention, therefore, provides a cost-effective and easy to manufacture mascara applicator having a plurality of bristles having varying bristle lengths. The applicator of the present application picks up and carries more mascara than conventional mascara applicators; it also applies the mascara in a smoother and more uniform manner and provides a better combing action with a reduced number of strokes when compared to conventional mascara applicators.

The invention and its particular features and advantages will become more apparent from the following detailed description when considered with reference to the accompanying drawings.

DETAILED DESCRIPTION OF THE DRAWINGS

Figure 1:
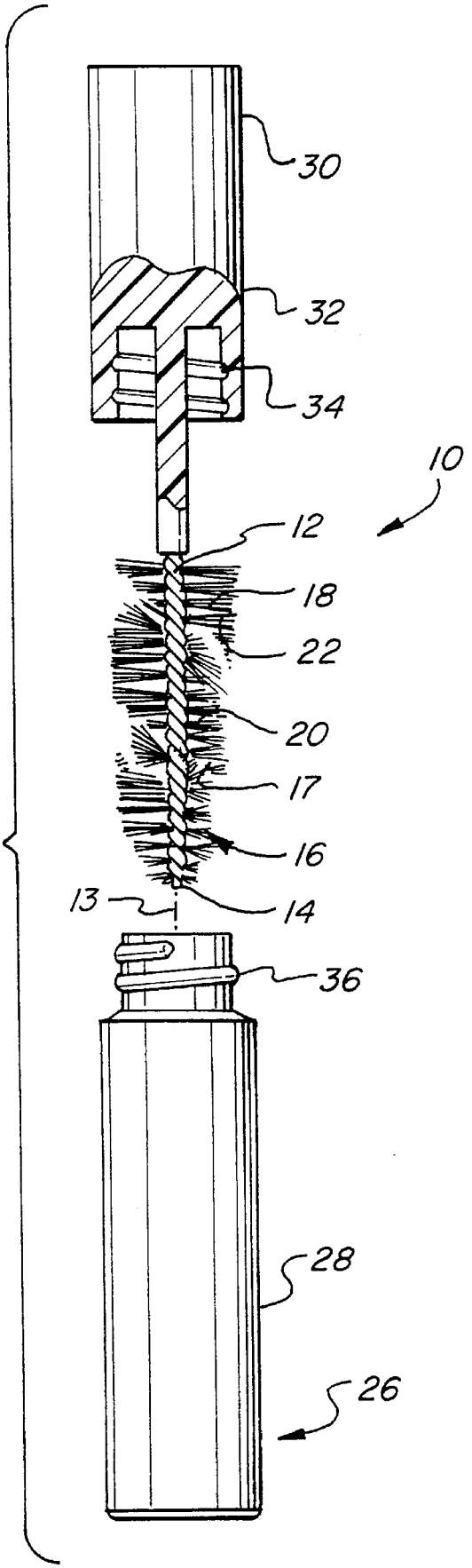
FIG. 1 is side view in partial cross section of a mascara applicator constructed in accordance with the present invention and a container.

Referring to the drawings in detail, a mascara applicator in accordance with the present invention is shown and generally designated by the reference numeral 10. It should be noted that for the sake of clarity all the components and parts of applicator 10 may not be shown and/or marked in all the drawings. As used in this description, the terms "up", "down", "top", "bottom", etc. refer to applicator 10 when in the orientation illustrated in FIGS. 2 and 4, for example, although it will be recognized that applicator 10 may be in any of various orientations when in use.

Figure 4:
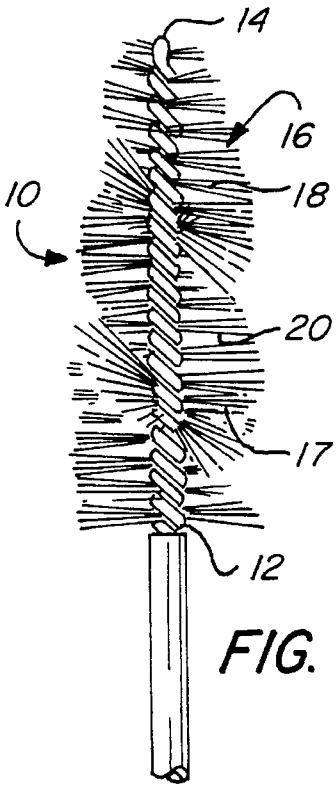
FIG. 4 is a side view of the applicator shown in FIG. 3 after its brush section has been rotated, most preferably, about three hundred sixty degrees.

As best shown in FIGS. 1, 4, applicator 10 comprises a central core 12 having a first end 14 and brush section 16 extending from first end 14 along central core 12 to form brush section 16. A helical array of regularly disposed and radially extending bristles, such as 18, 20 comprise brush section 16. Each bristle 18, for example, has two free ends, one end identified as 22 (FIG. 1), for example.

Applicator 10 is adapted in size and shape so as to be conveniently stored in a container 26, when not in use or when necessary to pick up mascara for application to a user's eyelashes. Container 26, having housing 28, has an internal chamber, or reservoir (not shown), for storing mascara as is known in the art. One suitable reservoir is shown and described in U.S. Pat. No. 4,365,642 to Costa, and entitled "Cosmetic Applicator and Associated Method", the disclosure of which is hereby incorporated by reference.

Core 12 can be made of any suitable material and by any suitable method sufficient to hold and retain bristles 18, 20, but it is most preferably made of stainless steel. See FIGS. 1, 4, 7.

Referring to FIG. 1, core 12 has bristles 18, 20, for example, disposed at one end (i.e., brush section 16), while the other end 30 comprises handle 32 to facilitate the application of the mascara and which also serves as a cap for container 26 when not in use. Handle 32 has threaded portion 34 designed so as to be received by complementary threaded portion 36 of container 26 to seal cap 32 to container 26 so that mascara is stored in a relatively air-tight manner.

A multiplicity of generally tubular shaped-bristles 18, 20, for example, sometimes referred to as filaments, are regularly disposed about brush section 16 of core 12 and are generally known in the art. See FIGS. 1, 4. Bristles 18, 20 can be made of any material capable of carrying and applying mascara and may be formed by any suitable method such as by the extrusion of a plastic material. Suitable materials include any type of synthetic material, including polyamide, polyesters, polyolefins and the like. Preferably bristles 18, 20 are made of nylon, and most preferably made of 6–12 type nylon.

Bristles 18, 20 preferably have a length of about 0.100 mils to about 0.380 mils. It should be understood, however, that bristles 18, 20 may be any length so long as they are sufficiently long to pick up and retain mascara and sufficiently long to comb the user's eyelashes.

Bristles 18, 20 may, as desired, be either hollow or solid, so long as bristles 18, 20 can suitably carry and apply mascara and are sufficiently rigid to comb a user's eyelashes. Bristles 18, 20 may have any suitable cross sectional configuration, such as cruciform or circular. Some suitable shapes are shown and described in U.S. Pat. No. 4,733,425 to Hartel et al., incorporated by reference herein.

Bristles 18, 20 are attached to core 12 in a manner generally known in the art. Preferably, core 12 is folded in a generally u-shaped configuration (not shown), forming two legs. Bristles, such as 18, 20 are substantially centrally disposed between the legs of the u-shaped core. The legs of core 12 are twisted to form a helical core which holds the bristles 18, 20 generally at their midpoints so as to clamp them in a helical or spiral manner.

Figure 2:
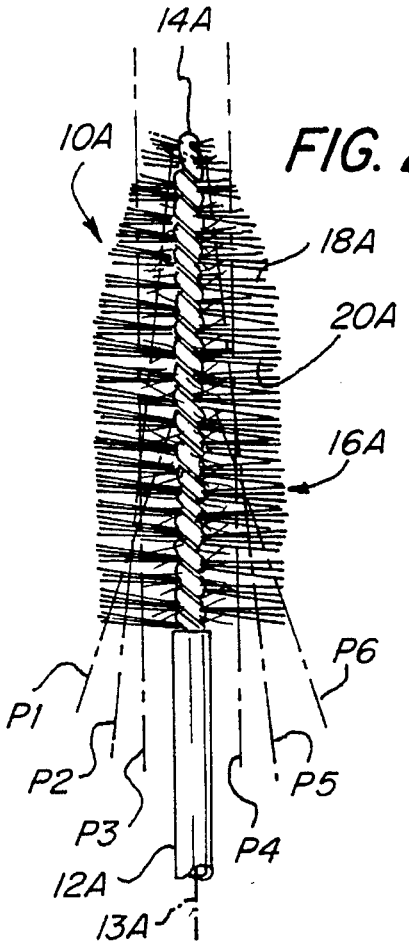
FIG. 2 is a side view of a mascara applicator showing a variety of lines along which different cuts could be made to render the desired grooves, or channels, with a portion broken away.
Figure 3:
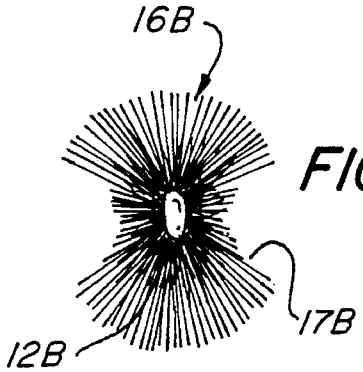
FIG. 3 is a top view of the applicator shown in FIG. 2 after cut outs have been made along paths P3 and P4 therein.
Figure 5:
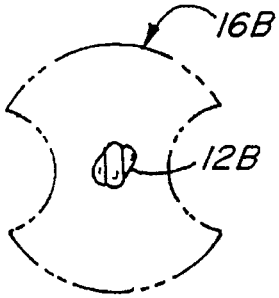
FIG. 5 is a schematic top view of the applicator shown in FIG. 3.

In accordance with the present invention, at least some portions of at least some of the bristles 18, 20, for example, in brush section 16A are removed, such as by cutting, for example, along paths P3 and P4 of brush 10A, shown in FIG. 2. After cuts along paths P3 and P4 have been taken, the resulting brush section 16B is shown in top view in FIG. 3 and schematically in FIG. 5.

Figure 6:
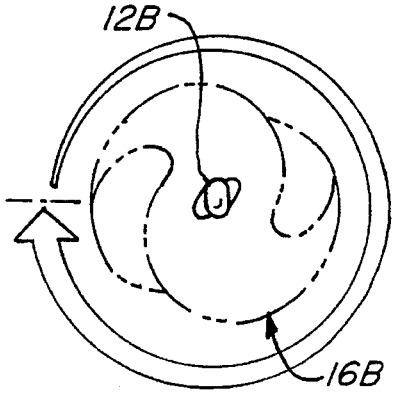
FIG. 6 is schematic top view of the brush section shown in FIG. 5 being rotated.

Further in accordance with the present invention, after desired cuts are made along predetermined paths P3 and P4, brush section 16B (FIGS. 3, 5) is then rotated about its longitudinal axis 13 (FIG. 1), from about one hundred eighty degrees to about four hundred eighty degrees as shown schematically in FIG. 6; preferably brush section 16B is rotated about three hundred sixty degrees about axis 13. It should be understood that brush section 16B can be rotated any number of turns, if desired, so long as the cut out portions or grooves (along paths P3, P4, for example) are sufficiently spiraled so as to form a helical groove through brush section 16B. It should also be understood that the rotation can be in either the clockwise direction (FIG. 6) or the counter-clockwise direction (not shown).

Figure 7:
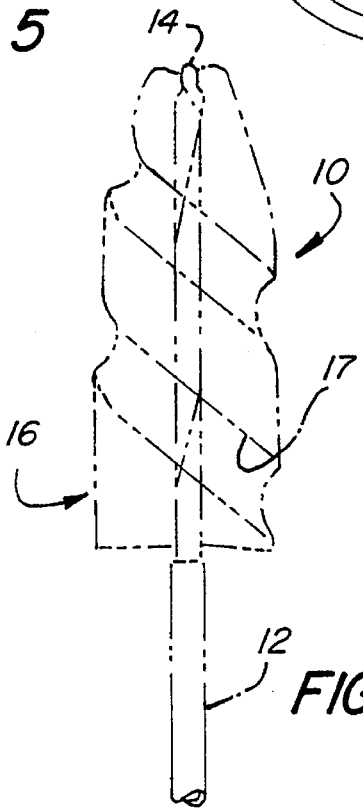
FIG. 7 is a schematic side view of the applicator of FIG. 6 after the brush section has been rotated, with a portion broken away.

After brush section 16B (FIGS. 3, 5) has had predetermined portions of at least some of the bristles, such as 18, 20 removed along paths P3 and P4, and after brush section 16B has been rotated (FIG. 6), the altered bristles form a helical groove 17 (FIGS. 1, 4, 7) throughout the brush section 16, as shown from the side in FIGS. 1, 4 and schematically in FIG. 7.

It should be understood that any number of paths can be cut through bristle section 16A (FIG. 2), paths P3 and P4 described above being illustrative only, and not intended to be limiting. For example, referring to FIG. 2, applicator 10A can be cut along any single path P1, P2, P3, P4, P5 or P6, or any desirable combination thereof. As shown, the paths may be substantially parallel to core 12A (such as path P3) or diagonal to the core 12A (such as P5 or P6). Any desired path may be taken so long as at least some portion of at least some bristles are removed, forming bristles having a reduced length.

Figure 9:
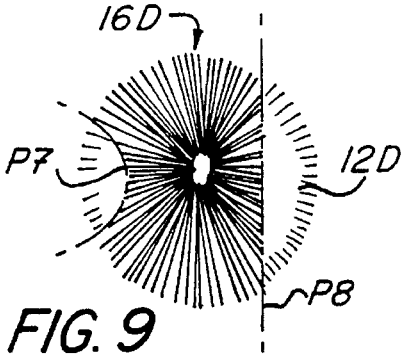
FIG. 9 is a top view of the applicator shown in FIG. 8.
Figure 10:
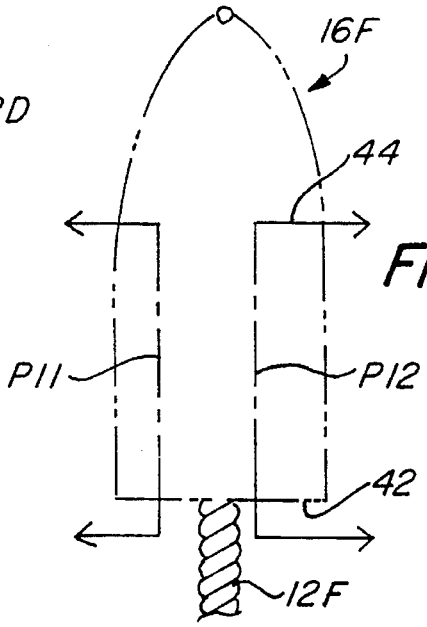
FIG. 10 is a schematic side view of an applicator similar to that shown in FIG. 8, except that a top portion of the brush section remains uncut, with portions broken away.
Figure 8:
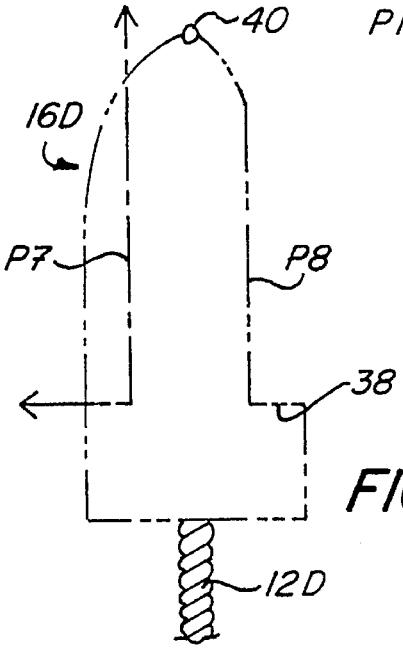
FIG. 8 is a schematic side view of an applicator having cut out portions taken or grooves made along lines substantially parallel to the core, such that a bottom portion of the brush section remains uncut, with portions broken away.

As shown in FIGS. 8–10, the brush sections 16D, 16F may have grooves that are asymmetrical about core 12D, 12F, respectively. For example, brush section 16D (shown schematically in FIG. 8 and from the top in FIG. 9) has cutouts or grooves taken along paths P7 and P8. Path P8 extends deeper into brush section 16D than path P7, and path P7 is curved, while path P8 is straight. Both paths P7 and P8 extend from a location 38 (FIG. 8) slightly below the center of the brush section 16D to the top 40 of brush section 16D. Alternatively, as shown in FIG. 10, paths P11 and P12 could extend sufficiently downward so as to remove at least a portion of the bottom 42 of brush section 16F and terminate at a location 44 slightly above the center point of the brush section 16F.

Figure 11:
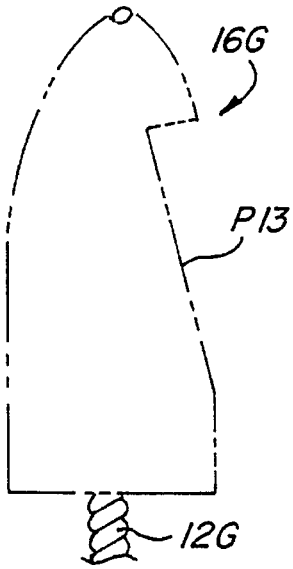
FIG. 11 is a schematic side view of an applicator having a cut out portion taken or a groove made along a line that is not parallel to the core, with portions broken away.
Figure 12:
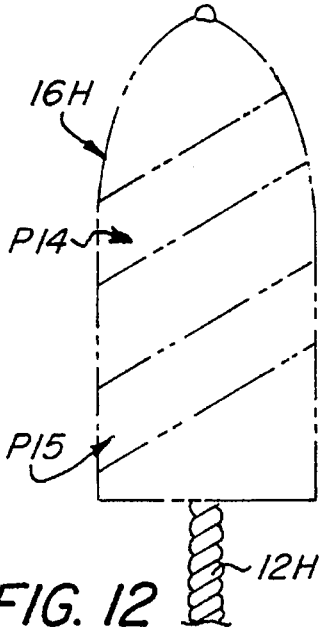
FIG. 12 is a schematic side view of an applicator having a plurality of grooves taken diagonally across the core, with portions broken away.
Figure 13:
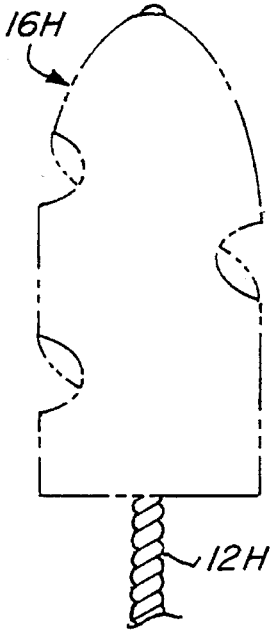
FIG. 13 is a schematic side view of the applicator shown in FIG. 12 rotated about ninety degrees, with portions broken away.

Alternative groove patterns are shown in FIGS. 11–12. FIG. 11 shows brush section 16G having a single cutout portion taken along path P13 which diagonally approaches core 12G. As shown in FIGS. 12–13, brush section 16H has cut out portions or grooves taken along paths P14 and P15, which diagonally cross core 12H.

A method for making mascara applicators 10 (FIGS. 1, 4, 7) in accordance with the present invention generally comprises the following steps. Referring to FIG. 2, first, a central core 12A is provided having brush section 16A at one end 14A thereof, central core 12A having an axis 13A extending therethrough. At least a portion of at least some of the bristles 18A, 20A are removed such as along path P4 so as to form a groove 17B (FIG. 3) in brush section 16B. Then brush section 16B or core 12B is rotated about one hundred eighty degrees to about four hundred eighty degrees about its longitudinal axis (not shown), forming a substantially helical groove 17 through brush section 16 (FIG. 1). Most preferably, brush section 16B is rotated about three hundred sixty degrees about its longitudinal axis.

It should also be understood that the invention has been described for use with mascara applicators for the sake of convenience only and is not intended to be limiting. Other articles may be made in a similar manner, such as paint brushes.

The present invention, therefore, provides a new and useful mascara applicators and method of making the same.

It should be understood that the foregoing is illustrative and not limiting and that obvious modifications may be made by those skilled in the art without departing from the spirit of the invention. Accordingly, reference should be made primarily to the accompanying claims, rather than the foregoing specification, to determine the scope of the invention.

What is claimed is:

1. An applicator for the application of mascara to the eyelashes, comprising: a central core formed from a twisted wire and having a brush section at one end thereof, the core having a longitudinal axis, the brush section comprising a plurality of regularly disposed and radially extending bristles, the bristles being disposed in a helical array by the twisted wire, at least some of the bristles having portions removed so as to form a substantially helical groove therethrough, the groove having a substantial depth and width, and the groove being substantially parallel to the longitudinal axis of the core.

2. The applicator for the application of mascara to the eyelashes of claim 1, the bristles being formed by an extrusion of a plastic material.

3. The applicator for the application of mascara to the eyelashes of claim 2, wherein the plastic material is nylon 6–12.

4. The applicator for the application of mascara to the eyelashes of claim 1, the groove defined by a substantially curved sidewall.

5. A method for making an applicator for the application of mascara to the eyelashes, comprising the following steps:

providing a central core formed from a twisted wire, the core having a brush section at one end thereof, the brush section comprising a plurality of regularly disposed and radially extending bristles at one end of the core, the brush section having an axis extending therethrough;

rotating the brush section of the core so that the bristles are disposed helically about the core;

cutting at least one groove longitudinally through the helically disposed bristles, the groove having substantial depth and width;

cutting at least one groove substantially parallel to the core; and rotating the brush section about one hundred eighty degrees to about four hundred eighty degrees about the longitudinal axis so that the groove is helically disposed about the brush section.

6. The method of claim 5, further comprising the step of cutting at least two groove through the brush section.

7. The method for making the applicator for the application of mascara to the eyelashes of claim 5, wherein the step of cutting the groove comprises the step of defining the groove by a curved sidewall.

8. A method for making an applicator for the application of mascara to the eyelashes, comprising the following steps:

providing a central core having a longitudinal axis extending therethrough;

positioning some regularly disposed and radially extending bristles at one end of the core;

rotating the core so that the regularly and radially extending bristles are disposed helically about the core;

cutting at least two grooves through the helically disposed bristles and substantially parallel to the longitudinal axis of the core;, at least one groove defined by a substantially curved sidewall and at least one groove defined by a substantially straight sidewall; and rotating the core about its longitudinal axis from about one hundred eighty degrees to about four hundred eighty degrees so that each of the grooves is helically disposed throughout a least a portion of the bristles.

9. A method for making an applicator for the application of mascara to the eyelashes, comprising the following steps:

providing a central core formed from a twisted wire, the core having a brush section at one end thereof, the brush section comprising a plurality of regularly disposed and radially extending bristles at one end of the core, the brush section having an axis extending therethrough;

rotating the brush section of the core so that the bristles are disposed helically about the core;

cutting at least two grooves longitudinally through the helically disposed bristles and substantially parallel to the core; and rotating the brush section about one hundred eighty degrees to about four hundred eighty degrees about the longitudinal axis so that the groove are helically disposed about the brush section.

10. A method for making an applicator for the application of mascara to the eyelashes, comprising the following steps:

providing a central core formed from a twisted wire, the core having a brush section at one end thereof, the brush section comprising a plurality of regularly disposed and radially extending bristles at one end of the core, the brush section having an axis extending therethrough;

rotating the brush section of the core so that the bristles are disposed helically about the core;

cutting at least two grooves longitudinally through the helically disposed bristles, each of the grooves having substantial depth and width, at least one groove substantially parallel to the core and at least one groove substantially non-parallel to the core; and rotating the brush section about one hundred eighty degrees to about four hundred eighty degrees about the longitudinal axis so that the groove is helically disposed about brush section.

11. A method for making an applicator for the application of mascara to the eyelashes, comprising the following steps:

providing a central core having a longitudinal axis extending therethrough;

positioning some regularly disposed and radially extending bristles at one of the core;

rotating the core so that the regularly and radially extending bristles are disposed helically about the core;

cutting at least two grooves through the helically disposed bristles, one groove defined by a substantially curved sidewall and the other groove defined by a substantially straight sidewall, one groove substantially parallel to the core and one groove substantially non-parallel to the core; and rotating the core about its longitudinal axis from about one hundred eighty degrees to about four hundred eighty degrees so that each of the grooves is helically disposed throughout a least a portion of the bristles.

* * * * *